US006390705B1

(12) United States Patent
Dailey

(10) Patent No.: US 6,390,705 B1
(45) Date of Patent: May 21, 2002

(54) CARRYING ASSEMBLY

(75) Inventor: Timothy J. Dailey, Brighton, CO (US)

(73) Assignee: Stuff Sorter by Versapak, Inc., Westminster, CO (US)

( * ) Notice: Subject to any disclaimer, the term of this patent is extended or adjusted under 35 U.S.C. 154(b) by 0 days.

(21) Appl. No.: 09/628,256

(22) Filed: Jul. 28, 2000

(51) Int. Cl.[7] ..... B03C 1/00; B03C 17/00

(52) U.S. Cl. ..... 401/35; 220/23.2; 220/23.8; 220/28.7; 220/696; 220/698; 220/742; 224/148.4; 224/148.7; 248/311.2; 248/316.8; 401/48; 401/121; 401/127; 401/130; 401/131; 401/140; 401/191; 401/194; 401/207

(58) Field of Search ..... 401/34, 35, 48, 401/121, 127, 130, 131, 140, 191, 194, 207; 224/148.2, 148.4, 148.7, 148.1, 270; 248/311.2, 312.1, 316.8; 220/23.2, 23.8, 287, 796, 696, 698, 695, 742

(56) References Cited

U.S. PATENT DOCUMENTS 599,461 A * 2/1898 Thomas ..... 220/698 X
667,233 A * 2/1901 Lecher ..... 401/35
1,254,714 A * 1/1918 McCombs ..... 220/698 X
1,715,144 A * 5/1929 Paulson ..... 401/121
2,709,540 A * 5/1955 Kenney ..... 220/696 X
3,893,607 A * 7/1975 Jones ..... 224/148.7 X
5,529,417 A * 6/1996 Burrlader ..... 401/194 X

* cited by examiner

*Primary Examiner*—Gregory Huson
*Assistant Examiner*—Kathleen J. Prunner
(74) *Attorney, Agent, or Firm*—Jacobson and Johnson

(57) ABSTRACT

A carrying assembly comprises a base, a shaft with a handle securely attached to the base, a first funnel and a second funnel (if required) connected to the shaft by an attaching member, a first dauber assembly, and a second dauber assembly. The combination of these parts creates a liquid carrying assembly that allows a user to transfer the liquid in its container from place to place and also allows the user to be able to quickly apply the liquid where ever desired without run-offs of the liquid and, after the user has finished with the use of the liquid, allows for an air-tight seal of the liquid in its container by a frictional force between the dauber assemblies and their funnels to prevent evaporation of the liquid.

7 Claims, 3 Drawing Sheets

FIG. 2
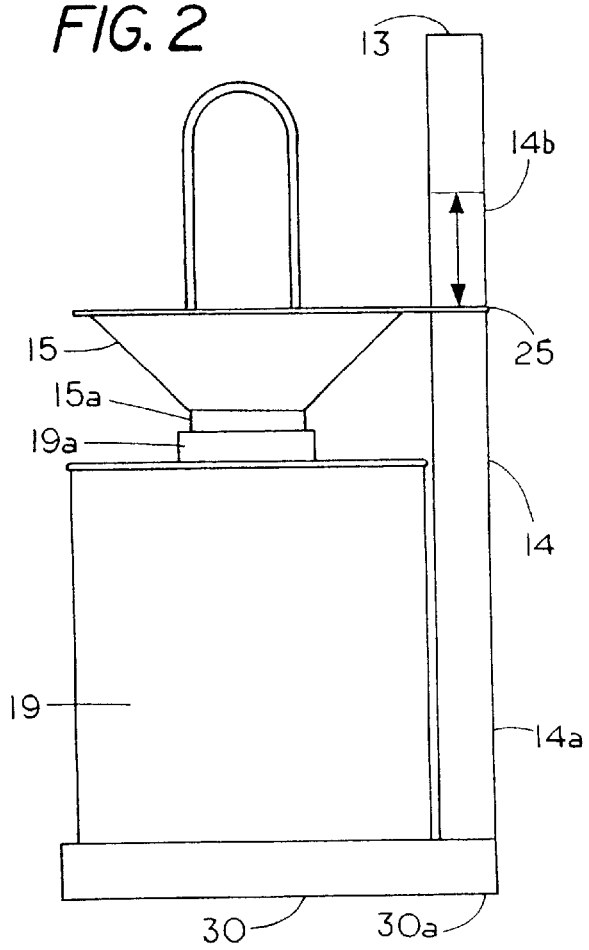
FIG. 3
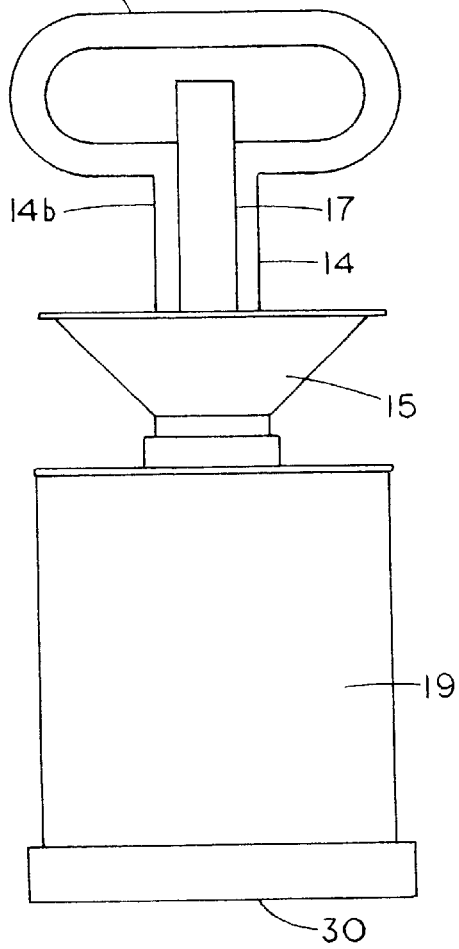
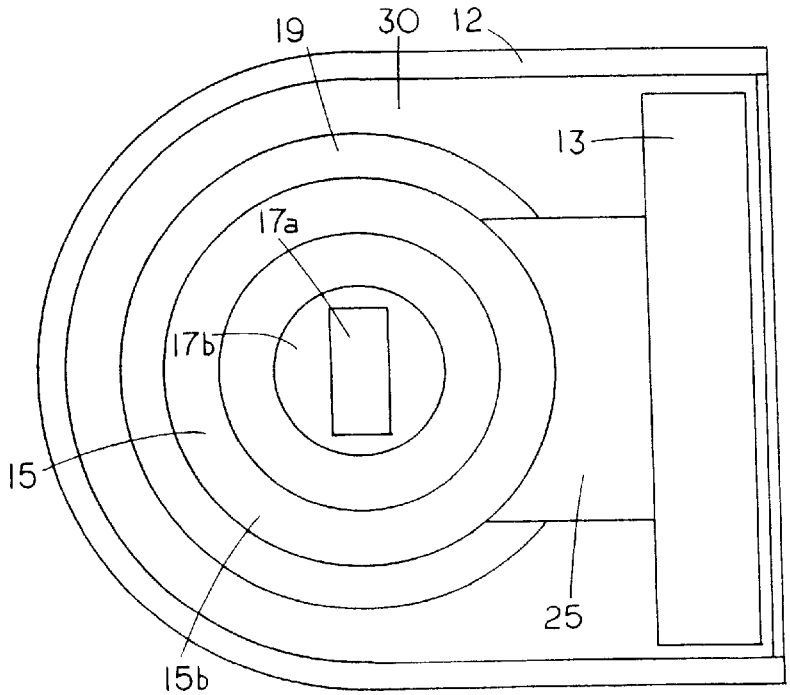
FIG. 4

CARRYING ASSEMBLY

FIELD OF INVENTION

This invention relates generally to applicator systems and carrier and more specifically to a carrying assembly which provides a user with the means to carry container(s) of liquid from place to place and to allow for quick access, application, and air-tight seal of the liquid in the container to prevent evaporation.

BACKGROUND OF THE INVENTION

When working on jobs which require the application of liquids (especially with quick drying solvents) it can be a burdensome job in having to open and close the container during the application process to prevent the liquid from evaporating and drying out. The process can also be very messy when the dauber/applicator used to transfer the liquid onto the desired surface drips liquid on the container and runs off the side of the container. In addition, the job is made difficult when the job requires the use of two different liquids, especially in high places that require the use of a ladder.

The present invention is a carrying assembly and application system designed to have a single or dual container carrying capability which provides a means for the container (s) to be securely carried with one hand. The transfer of liquid from the container to the desired surface is a quick one step process of dislodging the dauber assembly from a container engaging funnel, transferring the liquid on the dauber assembly onto the desired surface, and securing the dauber assembly back onto the container engaging funnel. The dauber assembly and the container engaging funnel are secured by a frictional force to prevent the evaporation of liquids in the container. During the application process the mouth of the funnel is sufficiently wide to catch drips of liquid from the dauber assembly and direct liquid run-offs of the drips back into the container to prevent run-offs on the side of the container.

SUMMARY OF THE INVENTION

Briefly, the present invention comprises a base, a shaft with a handle securely attached to the base, a first funnel (and a second funnel if required) connected to by an attaching member, a first dauber assembly, and a second dauber assembly. The combination of these parts create a liquid carrying assembly that allows a user to transfer the liquid in its container from place to place. In addition, the present invention allows the user to be able to quickly apply the liquid where ever desired without run-offs of the liquid and, after the user has finished with the use of the liquid, allowing for an air-tight seal of the liquid in its container by a frictional force to prevent evaporation of the liquid.

BRIEF DESCRIPTION OF THE DRAWINGS

FIG. 2 shows a front view of a carrying assembly with a base that supports one container;

FIG. 3 shows a side view of the carrying assembly of FIG. 2;

FIG. 4 shows a top view of the carrying assembly of FIG. 2;

DESCRIPTION OF THE PREFERRED EMBODIMENT

Figure 1:
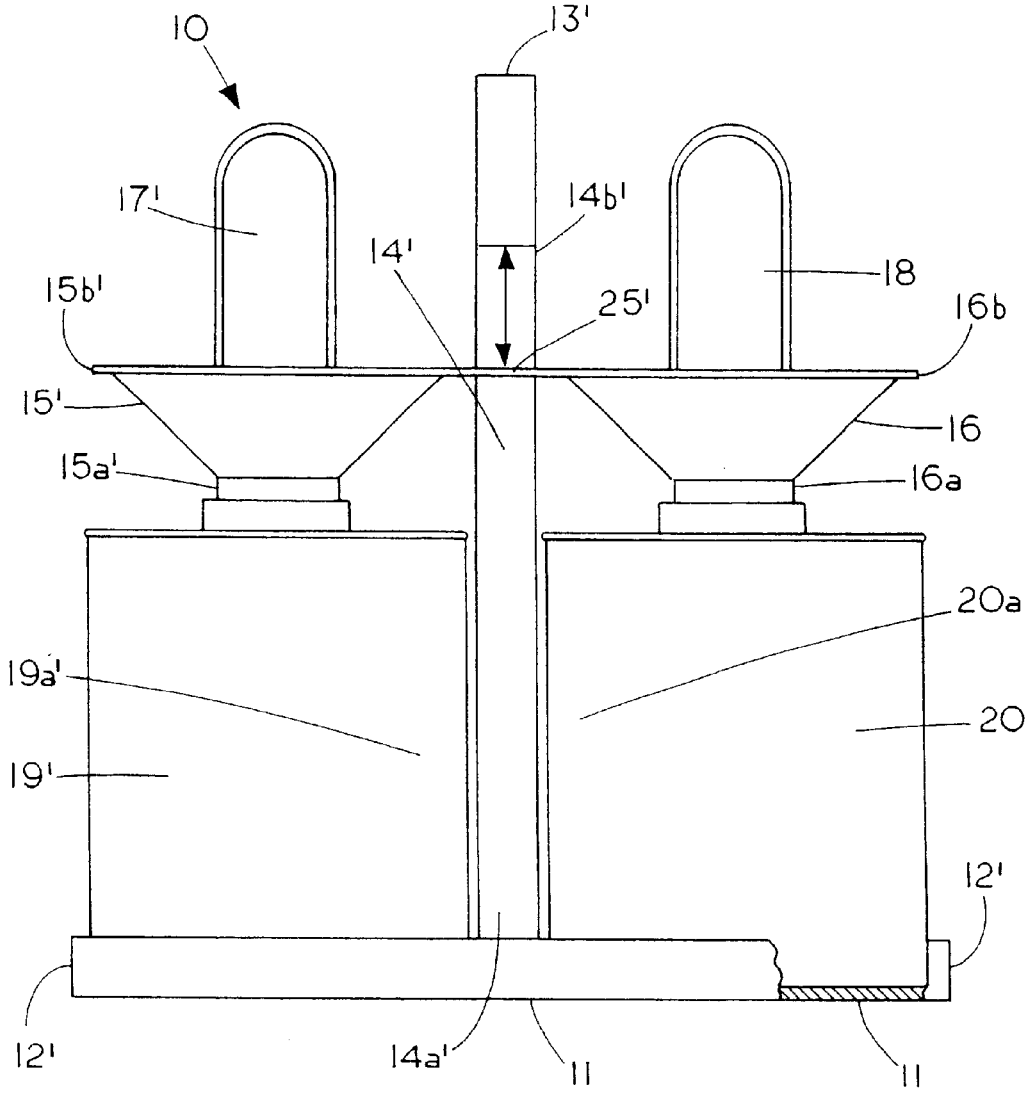
FIG. 1 shows a front view of a carrying assembly whose base can support two containers.

FIG. 1 shows a front view of a carrying assembly 10 that embodies the present invention. The complete assembly of the present invention comprises a base 11, a shaft 14' with a handle 13', a pair of funnels connected to each other by an attaching member 25', a first dauber assembly 17', and a second dauber assembly 18. The combination of these parts create a liquid carrying assembly that allows a user to transfer the liquid in its container from place to place. In addition, the present invention allows the user to be able to quickly apply the liquid where ever desired without run-offs of the liquid onto the exterior of the containers and, after the user has finished with the use of the liquid, allows for an air-tight seal of the liquid in its container to prevent evaporation.

Carrying assembly 10 comprises a base 11 composed of a rigid material for supporting containers. Surrounding the base 11 is a lip 12' as a means to secure the containers on base 11. Securely connected to the center of base 11 is a shaft 14' composed of a rigid material having a first end 14*a*' and a second end 14*b*'. The first end 14*a*' of shaft 14' is connected to the center of base 11. The attachment of shaft 14' divides up base 11 into a first side 19*a*' and a second side 20*a* allowing base 11 to support two separate containers. Securely connected to the second end 14*b*' of shaft 14' is an assembly handle 13' allowing the user to transfer carrying assembly 10 from place to place.

Located on the first side 19*a*' of base 11 is a first funnel 15' having a tapered end 15*a*' and a mouth 15*b*'. Tapered end 15*a*' is fitted to the spout of a first container 19' and secured to first container 19' by a frictional fit between funnel 15' and container 19'. Mouth 15*b*' is sufficiently wide to collect run-off liquids coming from first container 19' and allowing first container 19' to be refillable. Located on the second side 20*a* of base 11 is a second funnel 16 having a tapered end 16*a* and a mouth 16*b*. Tapered end 16*a* is connected to a second container 20 by a frictional fit between second funnel 16 and second container 20. Mouth 16*b* is also sufficiently wide to collect liquid run-offs. Securely connecting first funnel 15' to second funnel 16 is an attaching member 25'. Attaching member 25' is slideably attached to shaft 14' and is held in position by a frictional force between shaft 14' and attaching member 25' allowing attaching member 25' to support the funnels along shaft 14'. The movement of the funnels are directly related to the movement of attaching member 25'. When the containers needs to be removed from the assembly, attaching member 25' is slid along shaft 14' towards the second end 14*b*' of shaft 14' bringing along the funnels towards the same direction. The old containers are then removed and replaced with new containers. Attaching member 25' is then slid towards the first end 14*a*' of shaft 14' bringing the funnels toward the first end 14*a*' of shaft 14' until the funnels engage the containers with a frictional fit between the containers and the funnels.

Engaged within and protruding out from first funnel 15' is first dauber assembly 17'. First dauber assembly 17' permits the user to transfer the liquid in first container 19' to a desired surface after which first dauber assembly 17' is secured back on first funnel 15' by a frictional fit to create an air-tight seal thus preventing evaporation of the liquid. Engaged within and protruding out from second funnel 16 is second dauber assembly 18. Second dauber assembly 18 allows the user to apply the liquid in second container 20 to a desired surface. After the application of the liquid in second container 20 is completed second dauber assembly 18 is secured back to second funnel 16 by a frictional fit creating an air-tight seal to prevent evaporation. The handles on the dauber assemblies are color coded to give the user a visual indication of the type of liquid in each container.

The embodiment of this carrying assembly is designed to have a dual container carrying capability for jobs that would be efficient for the user to be able to carry two containers of liquid such as when two different types of liquids are needed for a job. In addition, this embodiment also allows for quick access, application, and air-tight seal of the liquid in the container to prevent evaporation.

FIG. 2 shows a front view of the carrying assembly with a different embodiment than that of FIG. 1. In the embodiment of FIG. 2 a single funnel 15 is frictionally mounted in the mouth 19*a* of container 19 and also frictionally held in vertical position by attaching member 25, which frictionally engages shaft 14.

FIG. 3 shows a side view of the carrying assembly of FIG. 2. FIG. 2 shows shaft 14 securely connected to a base 30 having an end 30*a*. Shaft 14 is connected to base 30 at first end 14*a* of shaft 14 and at end 30*a* of base 30. Connected to the second end 14*b* of shaft 14 is assembly handle 13 for carrying the assembly from place to place. As shown in FIG. 3 assembly handle 13 is oval shaped but can also have other various shapes such as rectangular. Funnel 15, shown in FIG. 2, is connected to attaching member 25 which is slideably attached to shaft 14 and held in position by a frictional force between shaft 14 and member 25. If desired, one could provide sufficient frictional engagement between funnel end 15*a* and container mouth 19*a* to hold the funnel in an upright position. However, the use of lateral attaching member 25 insures that the funnel will remain in the vertical orientation shown in FIG. 2 and FIG. 3.

Funnel 15 is shown connected to attaching member 25, which is held in position on shaft 14, shown in FIG. 2, by a frictional force between funnel 15 and container 19. Securely attached to shaft 14, shown in FIG. 2, is assembly handle 13, which permits the user to transfer the carrying assembly from place to place.

The embodiment of FIG. 2 and FIG. 3 allows the user to securely carry a liquid from place to place and to quickly apply the liquid in the container onto the desired surface without run-offs, and when the job is completed, provide for an air-tight seal to the container to prevent evaporation.

FIG. 4 shows a top view of the carrying assembly of FIG. 2. Surrounding base 30 is a circumferential lip 12, which is a means to prevent container 19 from sliding off base 30. Located in container 19 is funnel 15 with mouth 15*b* to catch run-offs of liquids from dauber 17*d* (shown in FIG. 5) and allowing container 19 to be refillable.

Figure 5:
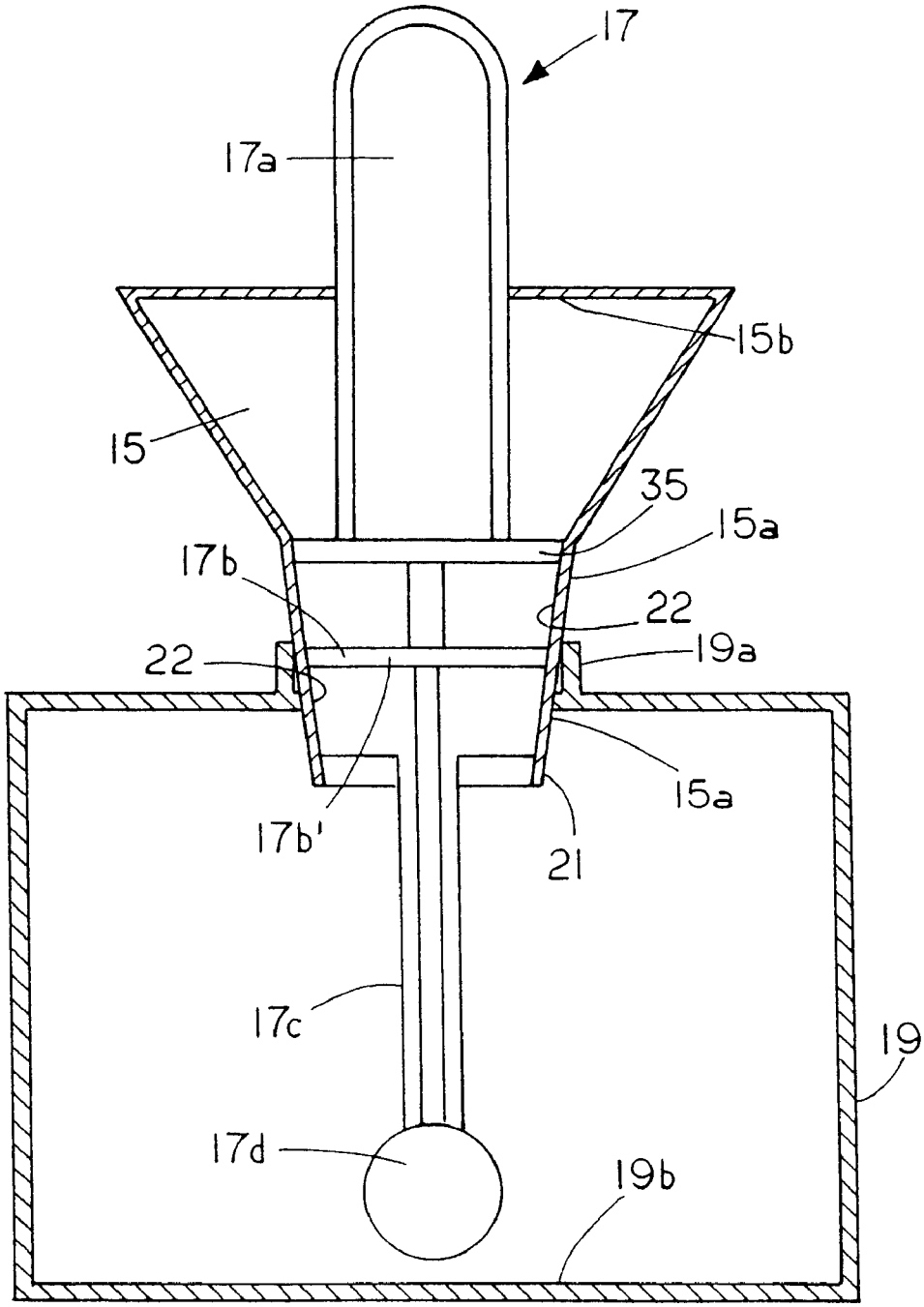
FIG. 5 shows a cross-sectional view of the connection made between the funnel, the dauber assembly, and the container of FIG. 2.

Referring to FIG. 5, located at the center of funnel 15 is a circular disk stop 17*b* having a tapered circumferential surface 17*b*' that mates with the circular interior tapered surface 22 of funnel 15, to create an air-tight seal to prevent evaporation of liquid in container 19. Attached to stop 17*b* is assembly handle 17*a* for connecting and dislodging stop 17*b* from funnel 15.

FIG. 5 shows a cross-sectional view of the connection made between first funnel 15, dauber assembly 17, and container 19 in FIG. 2. The tight fit connection between first funnel 15, dauber assembly 17, and container mouth 19*a* together creates an air-tight seal to prevent evaporation of liquid within container 19. That is, the container mouth 19*a* contains a circular opening and the funnel end 15*a* contains a frusto-conical shape so that a portion of the funnel end 15*a* can tightly engage container mouth 19*a* through a frictional fit therewith.

FIG. 5 shows funnel 15 with mouth 15*b* for collecting liquid run-offs from container 19 and tapered end 15*a* having a container engaging exterior surface 21 and a stop engaging interior surface 22. Connected to funnel 15 is dauber assembly 17 made up of four parts, an assembly handle 17*a*, a cap 35, a stop 17*b*, and a dauber 17*c*. Attached to the interior surface 22 of tapered end 15*a* and held in place by a frictional force is a disk stop 17*b* having a circumferential surface 17*b*'. Surface 17*b*' creates a seal with funnel surface 22 and funnel end 15*a* creates a liquid seal with container mouth 19*a* to trap liquid inside container 19. Connected to stop 17*b* is cap 35. Cap 35 supports stop 17*b* as stop 17*b* engages the interior surface 22 of funnel 15 and also prevents stop 17*b* from going accidentally jammed to tightly into container 19. Securely connected to cap 35 and protruding outward from mouth 15*b* of funnel 15 is assembly handle 17*a* . Assembly handle 17*a* provides a means for the user to frictionally secure and dislodge stop 17*b* from funnel 15. Connected to stop 17*b* and protruding from tapered end 15*a* of funnel 15 is dauber shaft 17*c* having an applicating tip 17*d* composed of a liquid holding material. Dauber 17*c* allows for the transfer of a liquid to a desire surface by allowing applicating tip 17*d* to collect the liquid in the container and engaging applicating tip 17*d* to the desired surface. Engaging the exterior surface 21 of tapered end 15*a* of funnel 15 is container 19. Container 19 and funnel 15 are secured to each other by a frictional force. In the embodiment shown the dauber shaft 17*c* extends sufficiently far into container 19 so that the applicating tip 17*d* is proximate container bottom 19*b* to enable a user to access the liquid in the container even if the container is almost empty.

The present invention thus is a carrying assembly and application system designed to have a single or dual container carrying capability which provides a means for the container(s) to be securely carried with one hand. The transfer of liquid from the container to the desired surface is a quick one step process of dislodging the dauber assembly from a container engaging funnel, transferring the liquid on the dauber assembly onto the desired surface, and securing the dauber assembly back onto the container engaging funnel. The dauber assembly and the container engaging funnel are secured by a frictional force to prevent the evaporation of liquids in the container. During the application process the mouth of the funnel is sufficiently wide to catch drips of liquid from the dauber assembly and direct liquid run-offs of the drips back into the container to prevent run-offs on the side of the container.

I claim:

1. A device for use in applying liquid comprising:

a first funnel and a second funnel, each of said funnels having a tapered end with an exterior surface for engaging a container, each of the ends of said funnels having a stop engaging interior surface, a first stop and a second stop, each of said stops having a surface for sealing a container, said first stop creating an air-tight seal when engaging the interior surface of the first funnel, said second stop creating an air-tight seal when engaging the interior surface of the second funnel;

a first dauber and a second dauber, said first dauber connected to the first stop, said second dauber connected to the second stop, each of said daubers having an applicating tip allowing for the transfer of a liquid;

a first handle and a second handle, said first handle connected to the first dauber and said second handle connected to the second dauber, each of said handles allowing a user to frictionally secure said stops to said funnels and to dislodge said stops from said funnels;

a container supporting base for supporting a first container and a second container, said base composed of a rigid material;

a shaft composed of a rigid material, said shaft having a first end and a second end, said first end of said shaft attached to said base;

an assembly handle connected to the second end of said shaft, said assembly handle allowing a user to transfer said device from place to place and to help support the removal of said stops from said funnels; and an attaching member, said attaching member being slideably attached to said shaft and held in position by a frictional force therebetween, said attaching member connected to said funnels and positionably supporting said funnels along said shaft.

2. The device claimed in claim 1 where each of said handles are color coded to provide the user with an indication of the type of solution that said daubers are submerged in.

3. A carrying assembly comprising:

a base, said base composed of a rigid material;

a container retaining lip;

a shaft composed of a rigid material, said shaft having a first end and a second end, said first end of said shaft securely attached to said base;

an assembly handle, said assembly handle securely attached to said second end of said shaft; said assembly handle allowing a user to hold and transfer said carrying assembly;

a first assembly side for holding a first container and a second assembly side for holding a second container, said first assembly side and said second assembly side being separated by said shaft;

a first funnel, said first funnel having a container engaging end and adapted to frictionally engage with the first container, said first funnel having a mouth for collecting a run-off of excess liquid;

a second funnel, said second funnel having a container engaging end and adapted to frictionally engage with the second container, said second funnel having a mouth for collecting the run-off of excess liquid;

an attaching member, said attaching member connecting said first funnel to said second funnel, said attaching member vertically and laterally supporting said funnels, said attaching member being slideably attached to said shaft and held in position by a frictional fit thereto;

a first stop, said first stop creating an air tight seal with said first funnel adapted to prevent the evaporation of solvent from said first container when said first stop engages an opening located at a first tapered end of said first funnel; and a second stop, said second stop creating an air tight seal with said second funnel adapted to prevent the evaporation of solvent from said second container when said second stop engages an opening located at a first tapered end of said second funnel.

4. The carrying assembly claimed in claim 3 in which said first stop includes a first dauber for obtaining solvent from said first container through the opening of said first funnel, said first dauber composed of a rigid material;

said first dauber having a handle to connect and dislodge said first stop from said first funnel; and a first dauber applicating tip adapted to allow the transfer of a solution from said first container.

5. The carrying assembly claimed in claim 4 in which said second stop includes a second dauber for obtaining solvent from said second container through the opening of said second funnel, said second dauber composed of a rigid material;

said second dauber having a handle to connect and dislodge said stop from said second funnel; and a second dauber applicating tip adapted to allow the transfer of a solution from said second container.

6. The carrying assembly claimed in claim 5 in which said first dauber handle and said second dauber handle are color coded for allowing a user visual detection of a type of solution within the container that said dauber is in.

7. The carrying assembly claimed in claim 3 in which said second end of said first funnel and said second end of said second funnel are sufficiently wide to allow said funnels to prevent an excess solution from running off of said funnels and to allow said containers to be refillable through their respective funnels.

* * * * *